United States Patent [19]

Pietryka

[11] Patent Number: 4,524,818

[45] Date of Patent: Jun. 25, 1985

[54] REPLACEMENT APPARATUS FOR GUIDE ROLL SEGMENT IN A CURVED GUIDE RACK OF A CONTINUOUS CASTING INSTALLATION

[75] Inventor: Joseph Pietryka, Versailles, France

[73] Assignee: Fives-Cail Babcock, Paris, France

[21] Appl. No.: 505,829

[22] Filed: Jun. 20, 1983

[30] Foreign Application Priority Data

Jun. 29, 1982 [FR] France ..... 82 11352

[51] Int. Cl.[3] ..... B22D 11/12

[52] U.S. Cl. ..... 164/448; 164/442

[58] Field of Search ..... 164/448, 442, 447, 441; 72/239

[56] References Cited

U.S. PATENT DOCUMENTS 3,994,334 11/1976 Schrewe ..... 164/448
4,316,494 2/1982 Scheurecker ..... 164/448
4,358,007 11/1982 Scheurecker ..... 164/442 X

FOREIGN PATENT DOCUMENTS 1957690 5/1971 Fed. Rep. of Germany ..... 164/448

*Primary Examiner*—Kuang Y. Lin
*Assistant Examiner*—J. Reed Batten, Jr.
*Attorney, Agent, or Firm*—Kurt Kelman

[57] ABSTRACT

To enable a segment of a cluster of bottom and top guide rolls to be readily replaced in a curved guide rack of a continuous casting installation, two fixed guide rails extend generally radially with respect to the curved guide rack at the two opposite sides of the guide roll support, rollers at opposite sides of the support engaging the guide rails for movement therealong, each guide rail including at least one portion inclined in relation to the generally radial direction of the guide rail and so disposed that, when the support is displaced along the guide rails, the support is pivoted into a skewed position which permits the support to pass between the two outer top guide rolls of two like segments adjacent thereto.

1 Claim, 2 Drawing Figures

Figure 1:
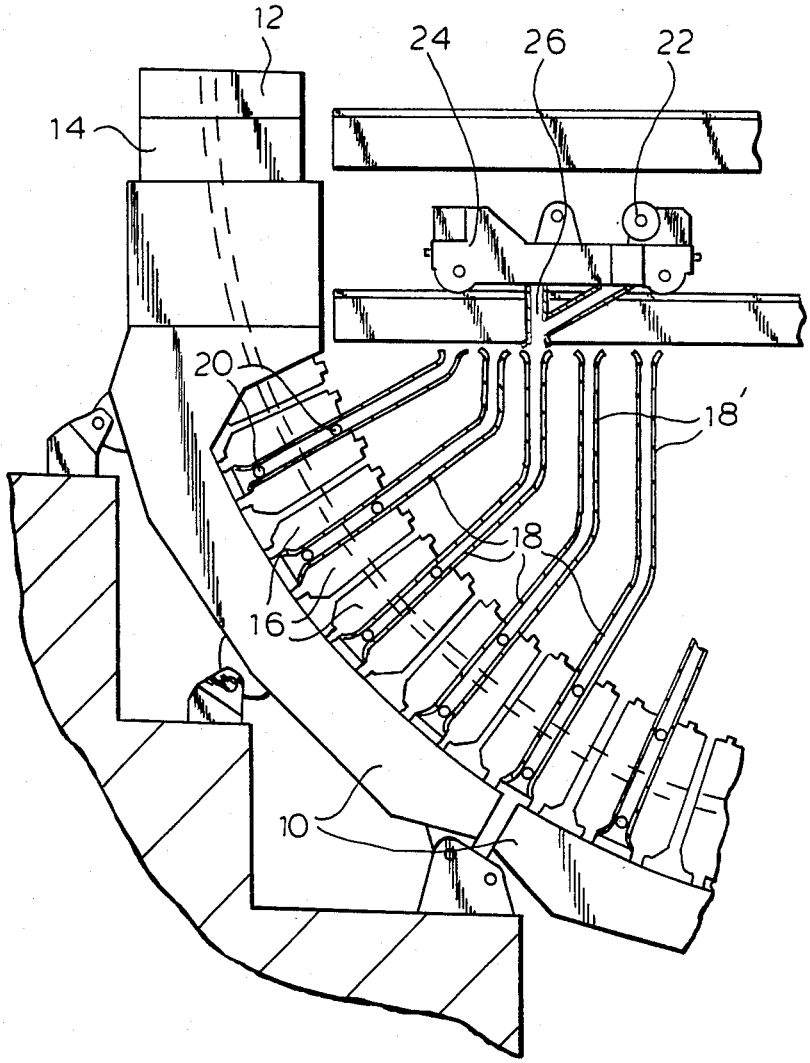
FIG.1 PRIOR ART

REPLACEMENT APPARATUS FOR GUIDE ROLL SEGMENT IN A CURVED GUIDE RACK OF A CONTINUOUS CASTING INSTALLATION

The present invention relates to an apparatus for placing a segment of a cluster of bottom and top guide rolls in a curved guide rack of a continuous casting installation and for removing the segment therefrom. In a known installation of this type, the curved guide rack is comprised of a series of adjacent segments, each segment comprising a support for the cluster of guide rolls and the support having two opposite sides extending generally radially with respect to the curved guide rack, and rollers at each one of the sides engaging two fixed guide rails extending generally radially with respect to the curved guide rack at the two opposite sides of the support.

As is well known, the cast product is guided from the outlet of a casting mold between two parallel rows of guide rolls. To facilitate the replacement of used or worn rolls, the guide rack is divided into segments each of which is comprised of a support carrying a cluster of bottom and top guide rolls wherebetween the cast product is guided and the segments are mounted on a support frame. Various means have been suggested for placing the segments on the support frame of the guide rack and for removing them therefrom and this invention is concerned with the type of installation hereinabove described and which comprises hoisting means for displacing the segment along the guide rails.

To maintain in the bottom and top rows of the guide rolls substantially the same spacing between the outer guide rolls of two adjacent segments and between the successive guide rolls of each segment, the supports have been given a substantially trapezoidal shape, the supports being wider at the level of the bottom guide rolls than at the level of the top guide rolls. Therefore, it is generally not possible to remove the segments from the support frame of the curved guide rack by displacing them radially towards the center of curvature thereof.

Various solutions have been proposed for overcoming this difficulty:

(1) It has been proposed to displace the segments towards the exterior, i.e. away from the center of curvature of the curved guide rack. This necessitates a curved guide rack support frame of complicated construction.

(2) According to another proposal, one of the outer bottom guide rolls of each segment is so mounted that it may be disassembled in place to permit the segment to be removed. This complicates the replacement of the segment because it requires the removable guide rolls first to be disassembled to enable the segment to be removed and, after the new segment has been put in place, this guide roll must be attached thereto.

(3) U.S. Pat. No. 3,994,334 proposes to fix one of the bottom guide rolls individually on the support frame. Since each segment has one less guide roll in the bottom row, its replacement poses no problem but difficulties are encountered in aligning the fixed rolls and the rolls on the segments after the same have been replaced.

It is the primary object of the invention to provide a simple solution for the easy and rapid replacement of segments of a cluster of bottom and top guide rolls in a curved rack of a continuous casting installation.

The above and other objects are accomplished in an apparatus of the first-indicated type according to the present invention by shaping the two fixed guide rails so that each guide rail includes at least one portion inclined in relation to the generally radial direction of the guide rail and so disposed that, when the support is displaced along the guide rails, the support is pivoted into a skewed position which permits passage between the outer top guide rolls of two like segments adjacent thereto.

Preferably, each guide rail includes two of said portions inclined in opposite directions, a bottom and a top one of the rollers being arranged at each side of the support, the support being pivoted into the skewed position by displacement of the top roller in one of the inclined guide rail portions and of the bottom roller in the other inclined guide rail portion.

Figure 2:
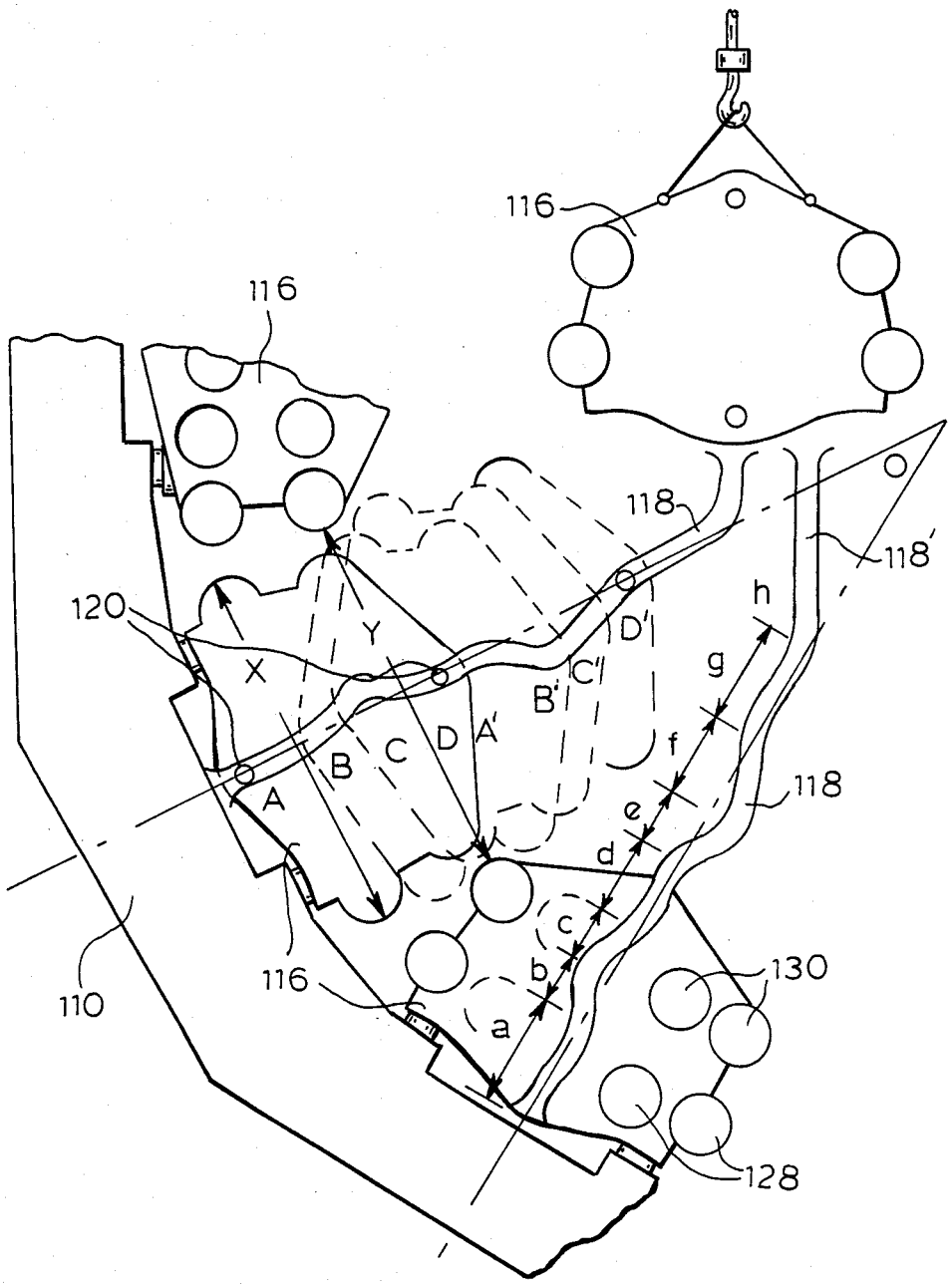

The above and other objects, advantages and features of this invention will become more apparent from the following detailed description of a now preferred embodiment thereof, taken in conjunction with the somewhat schematic drawing wherein FIG. 1 is a side elevational fragmentary view of a continuous casting installation showing the curved guide rack and a known apparatus for replacing a segment thereof; and FIG. 2 is an enlarged side elevational view of a portion of the curved guide rack and an apparatus according to the invention for replacing a segment thereof.

The apparatus shown in FIG. 1 is disclosed in published German patent application No. 1,957,690, published May 27, 1971, whose entire disclosure is incorporated herein by way of reference. The continuous casting installation is generally conventional and comprises support frame 10 of the curved guide rack and this support frame is constituted by strong curved girders resting on supports permitting their thermal expansion. Useful supports of this type are shown, for example, in my U.S. Pat. No. 3,779,303, dated Dec. 18, 1973. Support frame 10 carries casting mold 12. The guide rack for the cast product emerging from mold 12 comprises two parallel rows of horizontally extending idling guide rolls defining therebetween a curved passage for the cast product during its cooling. The top guide rolls extend in a row closer to the center of curvature of the curved rack and, therefore, having a smaller radius while the bottom guide rolls extend in a row having a larger radius of curvature. The curved guide rack is comprised of a series of individually replaceable segments adjacent each other. Uppermost segment 14 of the mold discharge rack immediately below mold 12 is removable upwardly after the mold has been removed in a known manner forming no part of the present invention.

For displacing segments 16 of the curved guide rack, two fixed guide rails 18 extending generally radially with respect to the curved guide rack are disposed at two opposite sides of the supports for the cluster of guide rolls. The guide rails extend in a direction parallel to the radii of the arc of a circle which constitutes the axis of a path for the cast product defined by the two rows of guide rolls. Rollers 20 are mounted at each side of the supports and engage the guide rails for movement therealong, the guide rails having a generally U-shaped cross-section for receiving the guide rollers.

The illustrated apparatus further comprises hoisting means for displacing respective segments 16 along guide rails 18. The illustrated hoisting means comprises winch 22 mounted on trolley 24 displaceable along a roller track mounted above the curved guide rack so that the segments may be hoisted or lowered while being guided along guide rails 18. At their upper ends, guide rails 18 are connected to vertically extending guide rail portions 18' and trolley 24 is equipped with matching guide rails 26 which may be aligned with respective ones of vertical guide rail portions 18'. In this manner, any segment may be readily transferred between the trolley and an aligned vertical guide rail portion so that a removed segment may be moved by the trolley to a repair shop and a new segment may be moved by the trolley to the curved guide rack for replacement.

In the known apparatus of FIG. 1, segments 16 are of rectangular cross section and they may be moved from and to the curved guide rack radially along guide rails 18 without problems.

In modern continuous casting installations, an effort is made to reduce the spacing between the guide rolls to a minimum to prevent bulging of the cast product, such as a steel bloom, slab or billet. This has been accomplished by imparting to the guide roll supports of the segments a trapezoidal shape, as is illustrated in connection with segments 116 of FIG. 2. In such segments, clearance X between outer bottom rolls 128 of one segment is larger than clearance Y between outer top rollers 130 of two adjacent segments. Therefore, it is not possible to remove the segment radially between the two adjacent segments along a straight path. For this reason, the present invention provides that guide rails 118 include at least one portion inclined in relation to the generally radial direction of the guide rails and so disposed that, when the support of segment 116 is displaced along the guide rails, the support is pivoted into a skewed position which permits passage between the outer top guide rolls of two like segments adjacent thereto.

Each guide rail 118, whose general direction is that of a radius of an arc of a circle having center 0 and which constitutes the axis of the path of the cast product defined between the bottom and top row of guide rolls, includes a first radial portion a-b, a portion b-c inclined towards the left and another portion c-d inclined towards the right, i.e. the two guide rail portions b-c and c-d are inclined in opposite directions in relation to the generally radial direction of the guide rail. The illustrated guide rails further include a second radial portion d-e, a portion e-f inclined towards the right, yet another portion f-g inclined towards the left and a third radial portion g-h leading towards the vertical portion 118' connected to the guide rail. The successive guide rail portions are interconnected by arcuate connecting portions of a radius sufficient to permit bottom and top rollers 120 to roll in the guide rails.

FIG. 2 illustrates the successive positions of a respective segment 116 in the course of its removal, the successive positions of bottom and top rollers 120 being indicated, respectively, by A, B, C, D and A', B', C', D'. Oppositely inclined guide rail portions b-c and e-f serve to pivot the segment and to place it thereby into a skewed position while guide rail portions c-d and f-g serve merely to connect these inclined portions to the radial portions. The length, angle of inclination and the position of portions b-c and e-f along the length of the guide rail depend on the dimensions of clearances X and Y as well as the spacing between the bottom and top rows of guide rolls. These inclined guide rail portions may be rectilinear or curved. In certain cases, it may suffice to provide a single inclined guide rail portion b-c or e-f. The inclinations of portions b-c and e-f in relation to the generally radial direction of the guide rail may be inverted, i.e. portion b-c may be inclined towards the right and portion e-f towards the left. The same holds true for portions c-d and f-g.

While the invention has been described hereinabove in connection with a now preferred embodiment, it will be understood that those skilled in the art may introduce various modifications without departing from the spirit and scope of this invention as defined in the appended claims.

What is claimed is:

1. An apparatus for placing a segment of a cluster of bottom and top guide rolls in a curved guide rack of a continuous casting installation and for removing the segment therefrom, the segment comprising a support for the cluster of guide rolls, the support having two opposite sides extending generally radially with respect to the curved guide rack, and a bottom roller and a top roller being arranged at each one of the sides, the apparatus comprising (a) two fixed guide rails extending generally radially with respect to the curved guide rack at the two opposite sides of the support, the bottom and top rollers engaging the guide rails for movement therealong, each guide rail including two portions inclined in opposite directions in relation to the generally radial direction of the guide rail and so disposed that, when the support is displaced along the guide rails, the support is pivoted into a skewed position by displacement of the top rollers in one of the inclined guide rail portions and of the bottom rollers in the other inclined guide rail portion, which permits passage between the outer top guide rolls of two like segments adjacent thereto, and (b) hoisting means for displacing the segment along the guide rails.

* * * * *